US007707734B2

(12) United States Patent
Alexander

(10) Patent No.: US 7,707,734 B2
(45) Date of Patent: May 4, 2010

(54) HANDS FREE CHALK LINE SNAPPER

(76) Inventor: Richard Alexander, 100 Westway, Mount Kisco, NY (US) 10549

( * ) Notice: Subject to any disclaimer, the term of this patent is extended or adjusted under 35 U.S.C. 154(b) by 0 days.

(21) Appl. No.: 12/150,242

(22) Filed: Apr. 25, 2008

(65) Prior Publication Data

US 2009/0025237 A1 Jan. 29, 2009

Related U.S. Application Data

(60) Provisional application No. 60/962,389, filed on Jul. 27, 2007.

(51) Int. Cl.
*B44D 3/38* (2006.01)

(52) U.S. Cl. ..... 33/414; 33/1 LE

(58) Field of Classification Search ..... 33/413, 33/414, 1 LE, 732
See application file for complete search history.

(56) References Cited

U.S. PATENT DOCUMENTS

| | | | | | |
|---|---|---|---|---|---|
| 1,557,031 | A | | 10/1925 | Conway | |
| 1,653,191 | A | * | 12/1927 | Savage | 33/414 |
| 3,126,637 | A | | 3/1964 | Short | |
| 4,660,291 | A | * | 4/1987 | Dehn | 33/414 |
| 4,765,557 | A | | 8/1988 | Kahmann | |
| 5,644,852 | A | | 7/1997 | Fuller et al. | |
| 5,699,622 | A | * | 12/1997 | Umbro | 33/414 |
| 5,727,324 | A | * | 3/1998 | Moore | 33/414 |
| 5,822,874 | A | | 10/1998 | Nemes | |
| 6,098,299 | A | * | 8/2000 | Collins et al. | 33/414 |
| 6,678,961 | B1 | * | 1/2004 | Panahi | 33/414 |
| 6,826,845 | B2 | * | 12/2004 | Pritchard | 33/414 |
| 6,944,962 | B2 | | 9/2005 | Tessel et al. | |
| 6,957,495 | B1 | * | 10/2005 | Schmillen | 33/414 |
| 2004/0211074 | A1 | | 10/2004 | Tessel et al. | |
| 2006/0000099 | A1 | | 1/2006 | Tessel et al. | |
| 2006/0185185 | A1 | | 8/2006 | Scarborough | |
| 2007/0068021 | A1 | | 3/2007 | Fisher | |

* cited by examiner

*Primary Examiner*—Amy Cohen Johnson
(74) *Attorney, Agent, or Firm*—Karl F. Milde, Jr.; Eckert Seamans Cherin & Mellott, LLC

(57) ABSTRACT

A chalk line marking device includes a chalk line that is held in a storing, dispensing and retracting device. The device comprises a housing and an element for gripping the chalk line when it is extended from the dispensing device and lifting it from the workpiece surface at a point remote from the device. A spring mechanism causes the gripping element to suddenly snap back to its original position, when released, thereby causing the chalk line to leave a linear chalk mark on the workpiece surface. The device may also comprise a gripping element arranged within the housing that includes a plunger responsive to movement of the housing, for lifting and suddenly releasing the gripping element. A worker can extend the chalk line with one hand while holding the dispensing device in the other hand. The hand holding the dispensing device can actuate the gripping element with the thumb, for example, of that same hand while the other hand holds the extended end of the chalk line in position, thereby not requiring a third hand to snap the chalk line.

7 Claims, 8 Drawing Sheets

HANDS FREE CHALK LINE SNAPPER

CROSS REFERENCE TO RELATED APPLICATION

This application claims priority of U.S. Provisional Patent Application Ser. No. 60/962,389, filed Jul. 27, 2007 under 35 U.S.C. §119(e).

BACKGROUND OF THE INVENTION

The present invention relates to a hands free device for marking a chalk line for use in construction, home improvement and the like.

Conventional chalk line marking devices employ a chalk line that is wound up around a spool within a case or dispenser. During use, the chalk line is extended and held taut near the workpiece surface to be marked. Typically, this requires two workers—one to hold the end of the chalk line and one to hold the dispenser. The chalk line is then grasped and released by one of the workers so that it snaps back toward the surface, thereby depositing a chalk line on the workpiece surface. Or, one worker may devise a way to secure one end of the line using a weight or the like. In any event, the procedure is inconvenient. A handle is attached to the dispenser to allow the line to be wound back into the case after use.

U.S. Pat. No. 6,944,962 discloses a chalk line marking device with an internal trigger mechanism for snapping a chalk line in combination with a chalk line positioning element. This marking device is quite complicated and costly in comparison to the within invention. Further, the '962 patent device does not snap the chalk line at a position remote from the device, nor does it disclose a plunger mechanism or cone-shaped housing as in the within invention.

SUMMARY OF THE INVENTION

A principle object of the present invention is to provide a chalk line that is "hands free." That is, a chalk line that can be operated and "snapped" by a single user, without requiring the assistance of a second worker. More particularly, it is a principle object of this invention to provide a chalk line that can be snapped by only one hand of the single user while the user's other hand is holding the chalk line in an extended position.

It is a further object of this invention to provide a chalk line dispensing device that includes a mechanism for lifting the chalk line away from the surface of the workpiece and then suddenly returning the chalk line to the surface, thus snapping the chalk line. The mechanism can be operated by one hand of the user, typically employing the user's thumb.

A chalk line marking device according to embodiments of this invention allows the user to easily mark a line in a desired location on a wall, floor or other surface without the need for another person. The invention provides a spring-loaded mechanism for snapping a linear chalk line against a surface to be marked, using only the hand holding the chalk line dispenser. The device is particularly useful for amateur and professional carpenters, kitchen cabinet installers, tile setters and so forth.

The chalk line marking device comprises a chalk line housing for storing, dispensing and retracting the chalk line around a spool or similar mechanism within the device. The housing is held in one hand of the user while the end of the chalk line is withdrawn by the other hand. The housing also has a handle, attached internally to the axis of the spool, which is used to re-wind or retract the chalk line into the dispenser after use. In the preferred embodiments, the marking device also includes a spring loaded mechanism connected to a gripper which can be actuated by the user. The gripper extends from the marking device and operates to lift the chalk line upward from the work surface at a position remote from the device. When the gripper is released, the spring causes the gripper to forcefully return to its original position, thereby snapping the chalk line and leaving a linear chalk mark on the workpiece surface. The gripper may comprise a handle for actuation by the user's thumb of the hand holding the housing, while the user's other hand holds the withdrawn end of the chalk line.

In a preferred embodiment, the chalk line marking device includes a spring loaded mechanism consisting of a coil spring affixed to the outer surface of the housing, located on the lower portion of the housing near an opening from where the chalk line is withdrawn. The coil spring could be permanently attached to the housing, or it could be removable. A gripper is connected at the lower end of the coil spring, at a point from which it pivots, and extends along the chalk line to a position remote from the housing. The end of the gripper comprises a hook which is placed under the chalk line. A handle may extend upward from the gripper at some point along its length, for access by the user's thumb to actuate the snap lever. By exerting lateral pressure on the handle, the user causes the gripper to pivot at its pivot point and therefore raise the chalk line, passing over the hook, from the surface of the workpiece remote from the housing. When the chalk line is raised to a sufficient degree, the handle is released and the spring causes the gripper and the hook to return forcefully to the workpiece surface, "snapping" the chalk line. In this embodiment, use of the device with one hand is facilitated.

In one embodiment of the chalk line marking device, the gripper is foldably attached to the housing without having a coil spring. When unfolded, the gripper extends away from the housing and has a hook for sliding under the chalk line, when the chalk line is extended. When stretched taut, the chalk line provides downward pressure on the hook and the gripper. Thus, when the gripper is raised from the workpiece surface by the user's thumb, tension in the chalk line causes the gripper to return suddenly to the workpiece surface when the gripper is released.

In another embodiment of the chalk line marking device, the gripper is located vertically and entirely within the dispenser. The lower end of the gripper comprises an eye through which the chalk line passes. The upper end of the gripper lever is configured to rest upon the upper surface of a ratchet or rotatable snap gear. When the snap gear rotates in a "tension cycle," it exerts upward pressure on the gripper, creating upward movement and creating tension on the internal spring. The upward movement raises the gripper and the chalk line from the workpiece surface. Continuing to rotate, the snap gear enters a "release cycle" wherein the gripper is suddenly propelled downward by force of the coil spring to the surface of the workpiece, snapping the chalk line. The snap gear can be actuated by a thumb button or small electric motor.

In a further embodiment of the chalk line marking device, the housing is cone-shaped and has an opening at the bottom and on the side of the cone through which the chalk line passes when extended. The opening on the side is a vertical slot which allows the chalk line to raise from the surface of the workpiece when it is lifted by an internal gripper. The housing also comprises a plunger that is actuated by downward pressure from the user's palm. When pressure is applied, the upper portion of the housing moves downward toward the cone-shaped portion of the housing, which actuates the internal gripper. The gripper is comprised of a collar and a sleeve, which is spring loaded, and which has a central channel for the chalk line. As the plunger moves downward, the collar and sleeve move upward by actuation of gears at the side. When the collar and sleeve reach a pre-determined height, the collar and sleeve holding the chalk line are suddenly released, snapping the chalk line to the surface of the workpiece.

BRIEF DESCRIPTION OF THE DRAWINGS

For a fuller understanding of the nature and objects of the invention, reference should be had to the following detailed description of embodiments of the invention taken in connection with the accompanying drawings.

DETAILED DESCRIPTION OF PREFERRED EMBODIMENTS

Figure 1:
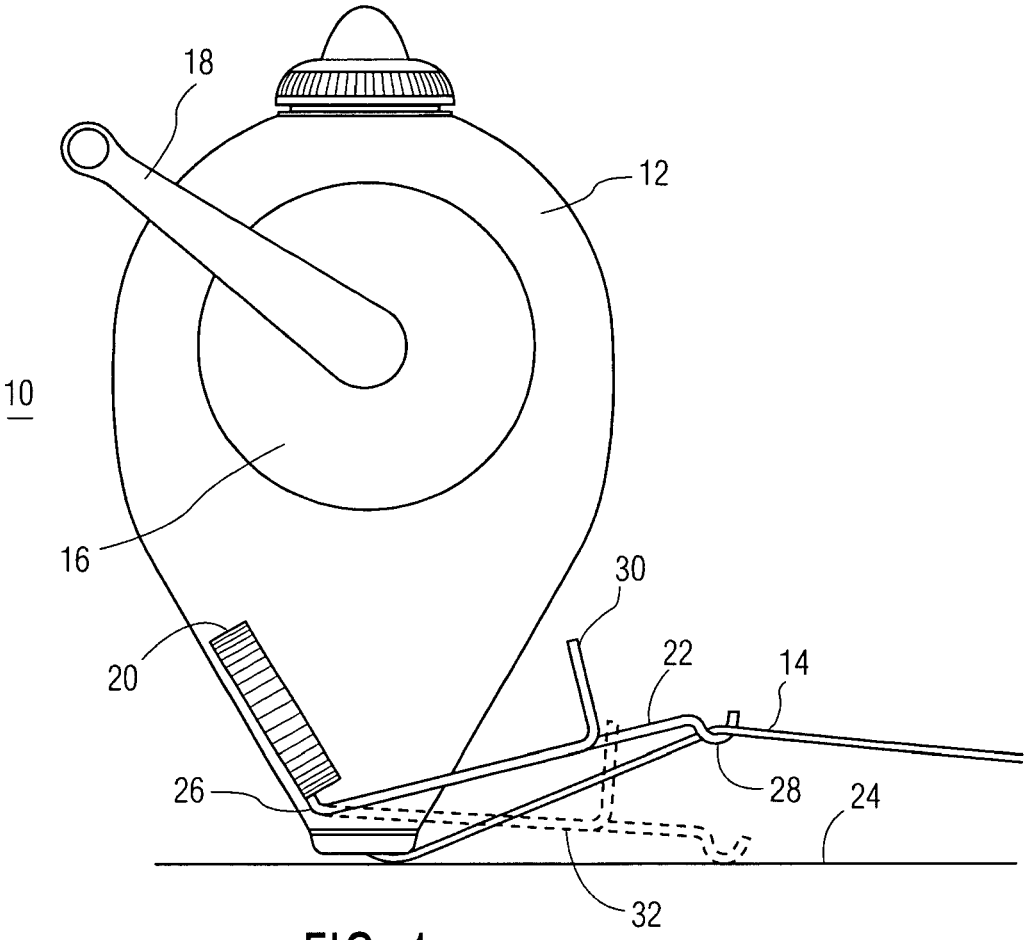
FIG. 1 is a perspective view of the chalk line marking device which includes an external coil spring-loaded gripper in accordance with an embodiment of the invention.

The preferred embodiments of the present invention will now be described with reference to FIGS. 1-6 of the drawings. Identical elements in the various figures are designated with the same reference numerals.

Figure 2:
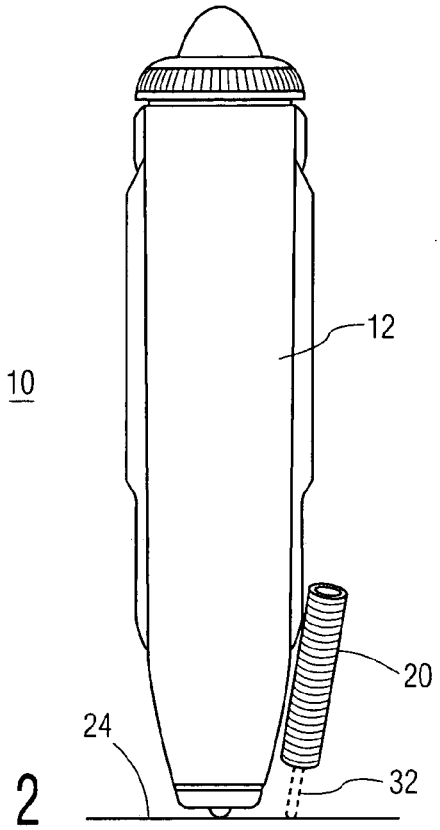
FIG. 2 is a side view of the embodiment of FIG. 1.
Figure 3:
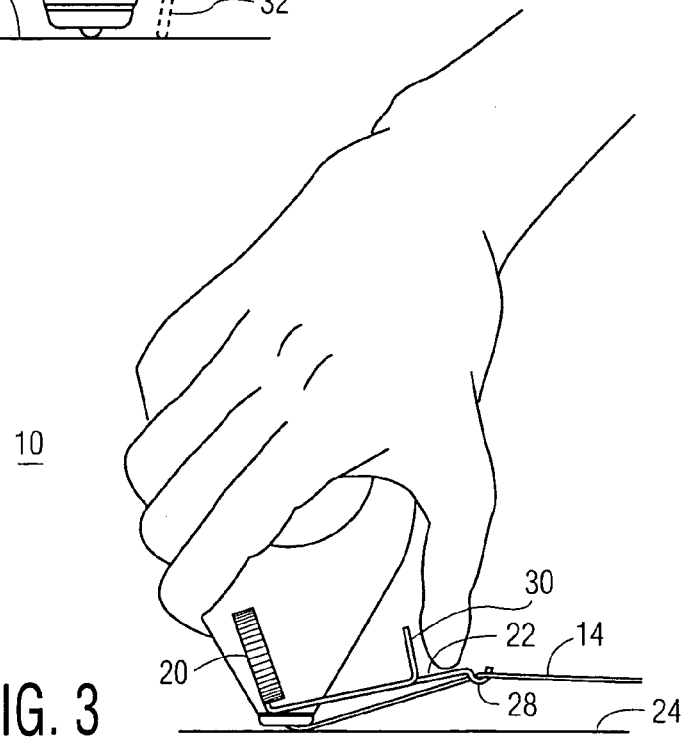
FIG. 3 illustrates a worker actuating the gripper of the embodiment of FIG. 1.

FIGS. 1-3 illustrate a first preferred embodiment of the hands free chalk line snapper according to the present invention, generally designated by the reference number 10. The chalk line snapping device comprises a housing 12 for dispensing, storing and retracting the chalk line 14, which is wrapped around a spool 16 or similar mechanism contained within housing 12. The housing 12 is held in one hand of the user (see FIG. 3) while the end of the chalk line is withdrawn by the other hand. The device also has a handle 18 attached internally to the axis of the spool, which is used to re-wind or retract the chalk line 14 into the housing 12.

The chalk line snapping device of this embodiment also includes a coil spring 20 connected to a gripper 22, which extends from the coil spring 20 and operates to lift the chalk line 14 upward from the workpiece surface 24. The coil spring could be permanently attached to the housing 12, or it could be removable. Gripper 22 is connected at the lower end of the coil spring 20, at a point from which it pivots 26, and extends along the chalk line 14. The end of the gripper 22 comprises a hook 28 which is placed under the chalk line 14. Gripper 22 also comprises a thumb handle 30 extending vertically from the gripper 22 at a point along its length. The user actuates the gripper 22 by exerting upward pressure with the user's thumb on the thumb handle 30. This causes the gripper 22 to pivot at its pivot point 26 from a resting position 32 on the workpiece surface 24, and therefore raise the chalk line 14, passing over the hook 28, to a raised position (see 22) from the workpiece surface 24. When the chalk line 14 is raised to a sufficient degree, the user releases the thumb handle 30 and the coil spring 20 causes the gripper 22 and the hook 28 to return forcefully to the workpiece surface 24, "snapping" the chalk line 14 and leaving a linear chalk mark on the workpiece surface 24.

Figure 4A:
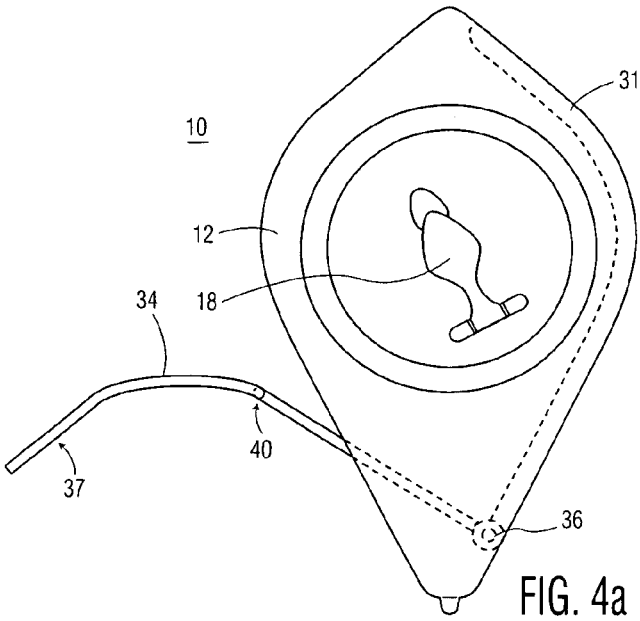
FIG. 4*a* is a front view of an embodiment of the invention having a foldable gripper.
Figure 4B:
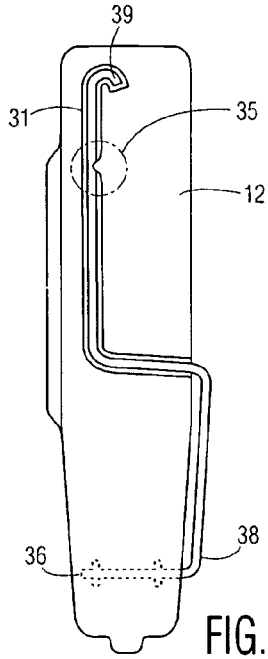
FIG. 4*b* is a side view of the embodiment of FIG. 4*a* having the gripper folded against the housing.
Figure 4C:
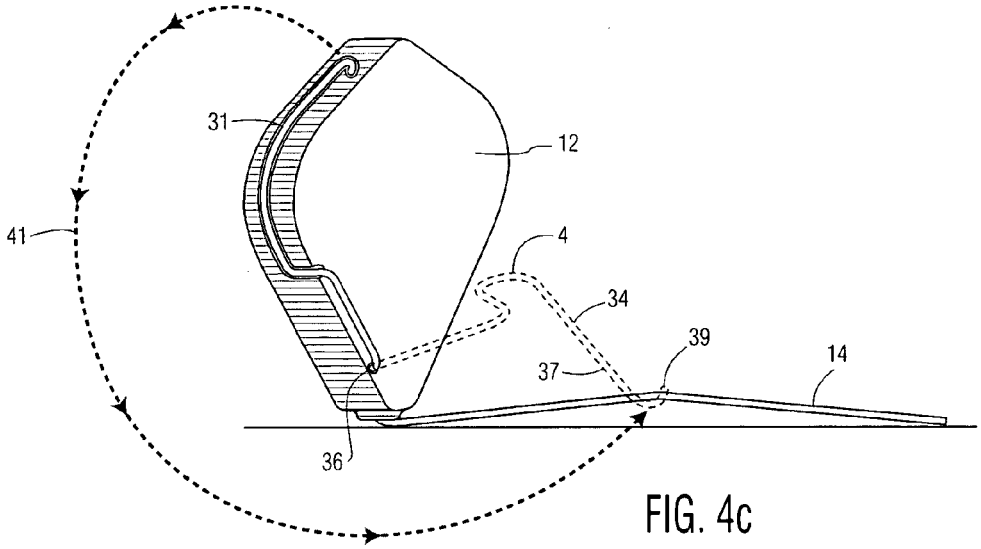
FIG. 4*c* is a perspective view of the embodiment of FIG. 4*a* illustrating the gripper positions.

FIGS. 4*a*-4*c* illustrate a second preferred embodiment of the present invention. In this embodiment of the chalk line snapping device 10, the gripper 34 is externally attached to the housing 12 at a pivot point 36, at a lower portion of the housing 12. The attachment of the gripper 34 at the pivot point 36 allows the gripper 34 to be folded against the housing 12, where it can be stored 31 and held in place by means of a snap fitting 35 on the side of the housing 12, when the gripper is not in actual use. The configuration of the gripper 34 is such that its shape conforms to the outside shape of the housing. One end 38 of the gripper 34 is configured to attach to the housing 12 at the pivot point 36, while the opposite end of the gripper 34 comprises a hook 39 over which the chalk line 14 passes when the gripper 34 is unfolded in an extended position 37. See FIGS. 4*a* & 4*c*. The gripper 34 further comprises a thumb lever 40 located at approximately the center of the length of the gripper 34. As shown, thumb lever 40 can be simply an angle bend in the gripper 34, or could be any other type of tab, extension or lever that could be configured to be engaged by the user's thumb when the gripper is in the unfolded position 37. As seen in FIG. 4*c*, when the gripper 34 is in the unfolded position 37, the chalk line 14 passes over the hook 39 when the chalk line 14 is extended along the workpiece surface. When the chalk line 14 is held taut, tension is provided on the gripper 34, much like the tension a spring would provide in another embodiment. In operation, the user applies upward pressure at the thumb lever 40, causing the chalk line 14 to be raised from the workpiece surface at position of the hook 39, remote from the housing 12. When the user releases the thumb lever 40, the tension from the chalk line 14 on the hook 39 causes the gripper 34 to return forcefully to the workpiece surface 24 (FIG. 4*c*), "snapping" the chalk line 14.

FIG. 4*c* illustrates the deployment of the gripper 34 of this embodiment, from a folded or stored position 31 to an extended or unfolded position 37. In so deploying, the gripper 34 rotates at the pivot point 36 as indicated by arc 41.

Figure 5A:
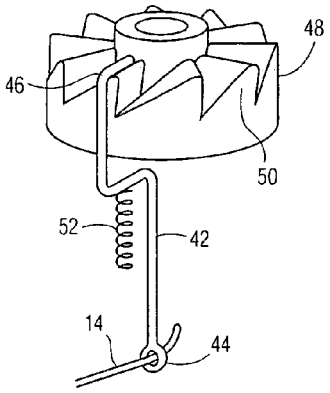
FIG. 5*a* is a view of a ratchet or snap gear of an embodiment of the invention during the tension cycle.
Figure 5B:
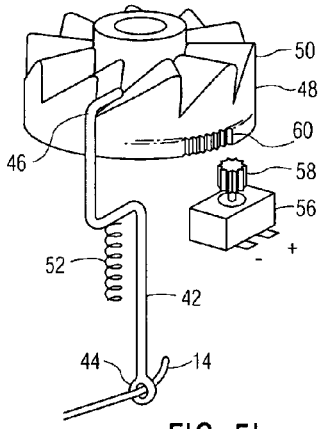
FIG. 5*b* is a further view the embodiment of FIG. 5*a* during the release cycle.
Figure 5C:
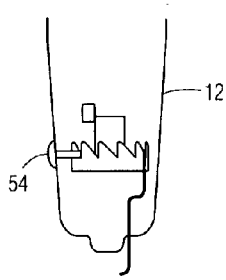
FIG. 5*c* is a further view the embodiment of FIG. 5*a* showing a method for actuating the snap gear.

FIGS. 5*a*-5*c* illustrate another embodiment of the chalk line snapping device where the snapping mechanism is contained within the housing. The gripper 42 is located vertically within the housing 12 (FIG. 5*c*). The lower end of the gripper 42 comprises an eye 44 through which the chalk line 14 passes. The upper end 46 of the gripper 42 is configured to rest upon the upper surface of a rotatable ratchet gear 48. When the ratchet gear 48 rotates during a "tension cycle" (FIG. 5*a*), diagonally inclined teeth 50 exert upward pressure on the gripper 42, creating upward movement and creating tension on the internal coil spring 52. The upward movement raises the chalk line 14 from the workpiece surface. Continuing to rotate, when the ratchet gear 48 enters a "release cycle" (FIG. 5*b*), i.e., when the upper end of the gripper 42 reaches the upper edge of teeth 50, the gripper 42 is suddenly propelled downward by force of the coil spring 52, to the surface of the workpiece, snapping the chalk line 14. The ratchet gear 46 can be actuated by a thumb button 54 located on the side of the housing 12, or by a small D.C. electric motor 56. The electric motor 56 would have a drive gear 58 for engagement with corresponding gear teeth 60 on the ratchet gear 48.

FIGS. 6*a*-6*e* illustrate another preferred embodiment of the chalk line snapping device where the internal snapping mechanism is actuated by downward pressure 62 on the top of the housing 12. In this embodiment, the housing 12 is comprised of an upper plunger portion 74 that is slidably connected to a lower, cone-shaped portion 76. Lower portion 76 has a vertical slot 78 which allows for egress of the chalk line when it is lifted from the workpiece surface by the gripper 64. The plunger portion 74 is configured to move with respect to the lower portion 76 when downward pressure is applied, thus activating the gripper 64 as further explained herein below. Lower portion 76 also has an opening 80 at the bottom of the cone for exiting the chalk line.

Figure 6A:
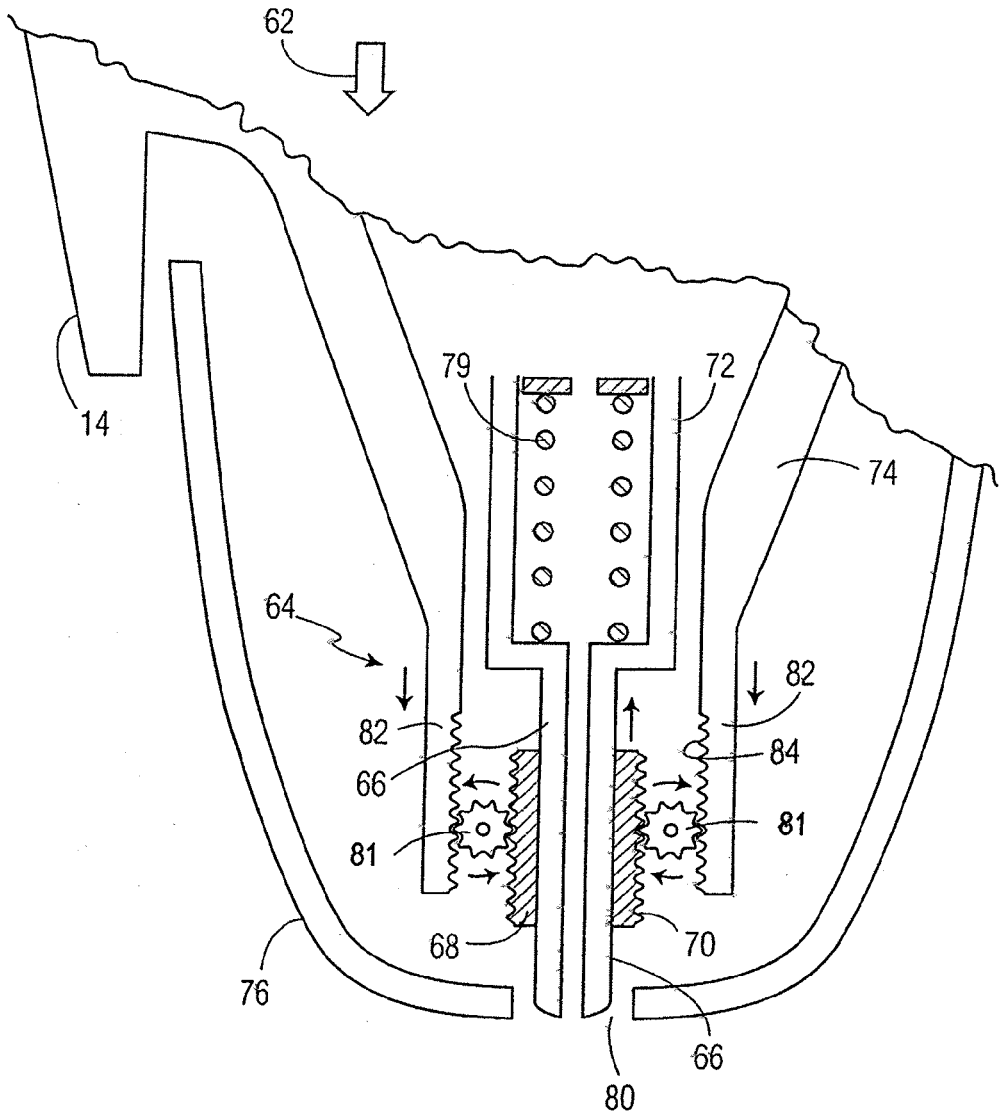
FIG. 6*a* is a cross-sectional view of an embodiment of the invention having an internal gripper comprised of a sleeve and collar.
Figure 6B:
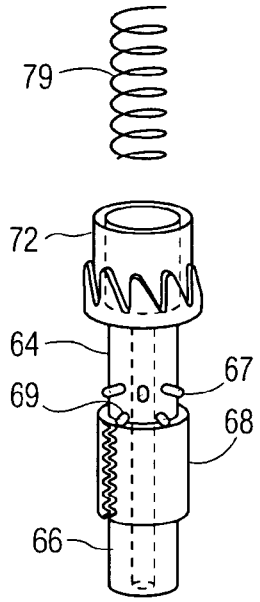
FIG. 6*b* is a close-up view of the embodiment of FIG. 6*a*.
Figure 6C:
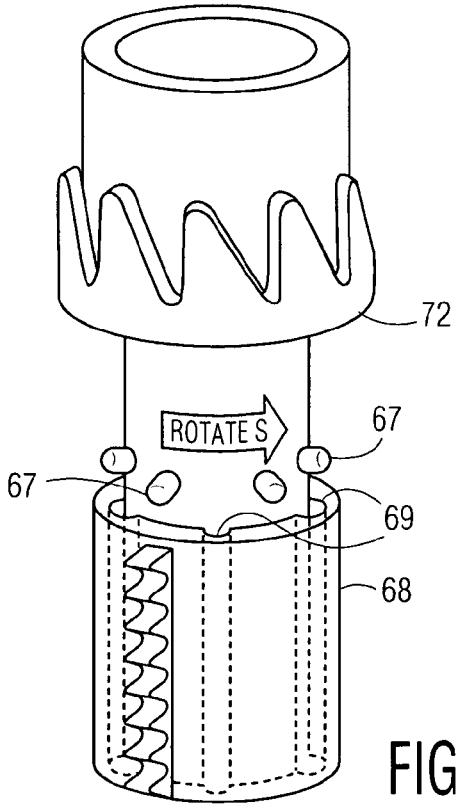
FIG. 6*c* is an external close-up view of the embodiment of FIG. 6*a*.
Figure 6D:
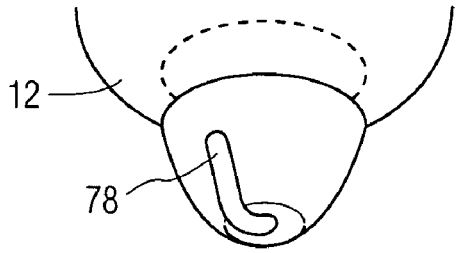
FIG. 6*d* is a perspective view of the tip of the chalk line snapping device of FIG. 6*a*.
Figure 6E:
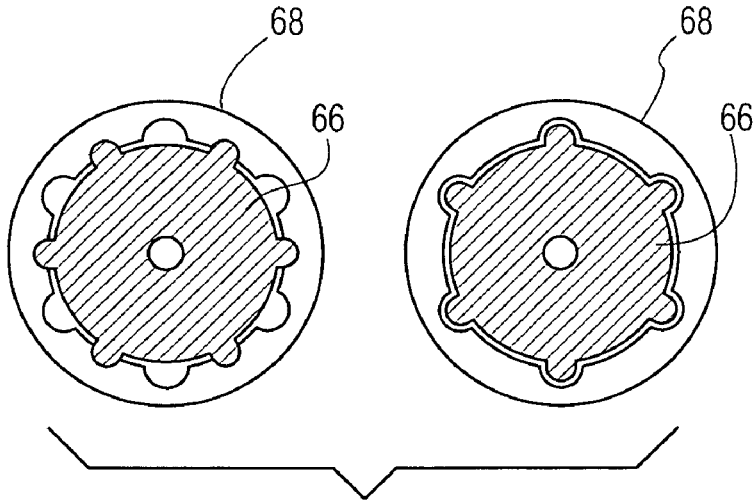
FIG. 6*e* are two plan views of the collar employed in the embodiment of FIG. 6*a*, showing rotation of a sleeve within a collar.

Gripper 64 is comprised of a hollow sleeve 66, through which the chalk line (not shown) passes, and having a collar 68 around the sleeve 66. The sleeve 66 is rotatable within collar 68, and also comprises a spring 79 for providing downward pressure on the sleeve 66. The sleeve 66 also comprises an upper cylinder 72 configured to cause sleeve 66 to rotate when it is raised. The serrated gears on the cylinder 72 contact a fixed object (not shown) rotating the sleeve 66 causing nipples 67 to slide off the shoulder formed by the top of collar 68 into slide grooves 69 in collar 68 as shown in FIG. 6*e*. Collar 68 also has teeth 70 vertically arranged on both sides for interconnection with fixed gears 81. Plunger 74 further comprises internal levers 82 also having teeth 84 for interconnection with the teeth on the fixed gears 81.

In order to crease a chalk mark on the workpiece surface using this embodiment, the device is vertically placed on the workpiece surface with the lower cone-shaped portion 76 being in contact with the surface. The chalk line is drawn outward from the housing 12 by one hand of the user, passing through opening 80 and vertical slot 78 in the cone-shaped lower portion 76 of the housing, and held taught. The user then applies downward pressure on plunger 74 with the other hand, causing it to slide downward with respect to the lower cone-shaped portion 76, which remains stationary. The downward motion of plunger 74 causes the internal levers 82 to also move downward, causing the fixed gears 81 to rotate against the teeth 70 of the gripper collar 68. The rotation of the fixed gears 81 raises the gripper 64 and the chalk line from the workpiece surface, the chalk line extending through the vertical slot 78. Spring 79 provides downward tension against the gripper 64 as it is being raised. As sleeve 66 is forced upward, it reaches a point of disengagement with the collar 68. The sleeve 66 then rotates out of a locked position in the collar 68 into slide grooves of collar 68, where the spring 79 then suddenly returns the gripper 64 to the workpiece surface, thus snapping the chalk line. This embodiment operates in a similar manner as a ballpoint pen up/down mechanism.

While the invention has been described and illustrated in connection with the preferred embodiments, many variations and modifications as will be evident to those of skilled in this art may be made without departing from the spirit and scope of the invention, and the invention is thus not limited to the precise details of methodology or construction set forth above as such variations and modifications are intended to be included within the scope of the invention.

What is claimed is:

1. An apparatus, operable by two hands of a user, for snapping a chalk line against a surface of a workpiece, so as to leave a linear chalk mark on the workpiece surface, said apparatus comprising, in combination:

(a) a housing for storing, dispensing and retracting a chalk line, said chalk line having a free end that is capable of being gripped by one hand of the user and drawn away from the housing to extend the chalk line over the workpiece surface, and (b) an element, attached to the housing, having a gripper, for lifting the chalk line away from the workpiece, when the chalk line is extended from the housing and stretched taught, and releasing the gripper suddenly to allow the extended chalk line to snap against the workpiece surface, said element being adapted to be operated manually by the other hand of the user, and said element extending outward and supporting said gripper at a point remote from said housing.

2. The apparatus defined in claim 1, wherein said element includes a lever adapted to be pressed by a thumb of said other hand.

3. The apparatus defined in claim 1, wherein said element includes a spring for applying force to the gripper, to restore the gripper to an original position adjacent the workpiece surface, after lifting the chalk line away from the workpiece surface.

4. A method for snapping a chalk line against a surface of a workpiece, so as to leave a linear chalk mark on the workpiece surface, said method comprising the steps of:

(a) using one hand, drawing a free end of a chalk line outward away from a chalk line dispensing device to extend the chalk like over the workpiece surface, wherein the chalk line dispensing device comprises a housing for storing, dispensing, and retracting a chalk line, and (b) using another hand, holding the dispensing device on the workpiece surface and, while maintaining the chalk line dispensing device on the workpiece surface, lifting the extended chalk line away from the workpiece surface when stretched taught using an element attached to the housing, said element having a gripper, said element extending outward and supporting said gripper at a point remote from the said housing, and suddenly releasing the chalk line to allow the extended chalk line to snap against the workpiece surface, thereby leaving a linear chalk mark on the workpiece surface.

5. The method defined in claim 4, wherein step (b) is performed by a thumb of the hand holding the dispensing device.

6. An apparatus, operable by two hands of a user, for snapping a chalk line against a surface of a workpiece, so as to leave a linear chalk mark on the workpiece surface, said apparatus comprising, in combination:

(a) housing for storing, dispensing and retracting a chalk line, said chalk line having a free end that is capable of being gripped by one hand of the user and drawn away from the housing to extend the chalk line over the workpiece surface, said housing having a cone-shaped portion with an opening for egress of the chalk line, and (b) an element, arranged within the housing, having a gripper, for lifting the chalk line away from the workpiece, when the chalk line is extended from the housing and stretched taught, and releasing the gripper suddenly to allow the extended chalk line to snap against the workpiece surface, said element being adapted to be operated manually by the other hand of the user, and said element including a plunger, responsive to movement of the housing toward the workpiece surface, for lifting and suddenly releasing the gripper, wherein said element includes a spring for applying force to the gripper, to restore the gripper to an original position adjacent the workpiece surface, after lifting the chalk line away from the workpiece surface.

7. The apparatus defined in claim 6, wherein said element includes a lever adapted to be pressed by a thumb of said other hand.

* * * * *